US007721531B2

(12) United States Patent
Palestrant

(10) Patent No.: US 7,721,531 B2
(45) Date of Patent: May 25, 2010

(54) ATOMIZING-NOZZLE ORIFICE INSERT AND METHOD FOR MANUFACTURE THEREOF

(75) Inventor: Nathan Palestrant, Scottsdale, AZ (US)

(73) Assignee: The Palestrant Family Trust, Scottsdale, AZ (US)

( * ) Notice: Subject to any disclaimer, the term of this patent is extended or adjusted under 35 U.S.C. 154(b) by 1792 days.

(21) Appl. No.: 10/324,474

(22) Filed: Dec. 20, 2002

(65) Prior Publication Data

US 2004/0118946 A1 Jun. 24, 2004

(51) Int. Cl.
*F01N 3/00* (2006.01)

(52) U.S. Cl. ..... 60/286; 60/274

(58) Field of Classification Search ..... 239/461, 239/463, 491; 60/274, 286
See application file for complete search history.

(56) References Cited

U.S. PATENT DOCUMENTS

| | | | | | |
|---|---|---|---|---|---|
| 2,305,210 | A * | 12/1942 | Wahlin | 239/601 |
| 2,981,483 | A * | 4/1961 | Pichon | 239/464 |
| 2,999,648 | A * | 9/1961 | Wahlin et al. | 239/487 |
| 3,672,578 | A * | 6/1972 | Wayne | 239/590 |
| 3,923,253 | A * | 12/1975 | Stewart | 239/463 |
| 4,736,893 | A * | 4/1988 | Norskov | 239/590.3 |
| 5,002,230 | A * | 3/1991 | Norskov et al. | 239/533.15 |
| 5,433,383 | A * | 7/1995 | Sundholm | 239/383 |
| 5,615,836 | A * | 4/1997 | Graef | 239/428.5 |
| 5,927,611 | A * | 7/1999 | Palestrant | 239/380 |
| 6,708,907 | B2 * | 3/2004 | Fochtman et al. | 239/585.1 |
| 2002/0170987 | A1 * | 11/2002 | Aoki et al. | 239/585.4 |

* cited by examiner

*Primary Examiner*—Thomas E Denion
*Assistant Examiner*—Diem Tran
(74) *Attorney, Agent, or Firm*—Meschkow & Gresham, P.L.C.

(57) ABSTRACT

An atomizing nozzle (100) for use in a misting system and a process (300) for manufacturing the atomizing nozzle (100) are provided. The atomizing nozzle (100) is made up of a nozzle body (104), an orifice insert (106), and an impeller. The nozzle body (104) has an inlet end (110), has an outlet end (112), has an insert recess (116) proximate the outlet end (112), and encompasses a first chamber (122). The metallic orifice insert (106) is fabricated from a metallic sheet material (140) and affixed to the nozzle body (104) within the insert recess (116) and encompasses a second chamber (148). The non-metallic impeller (108) is configured to reside within the first and second chambers (122,148) between the metallic orifice insert (106) and the nozzle inlet end (110).

23 Claims, 7 Drawing Sheets

ATOMIZING-NOZZLE ORIFICE INSERT AND METHOD FOR MANUFACTURE THEREOF

TECHNICAL FIELD OF THE INVENTION

The present invention relates generally to mist heads, which atomize pressurized fluid. Specifically, the present invention relates to atomizing nozzles that are configured to consistently produce a uniform fine mist.

BACKGROUND OF THE INVENTION

Atomizing nozzles, also called mist heads, are used in connection with misting systems to produce a fog or fine mist. A fluid, typically water, is forced under pressure through the atomizing nozzles to produce the mist. Desirably, the mist is sufficiently fine so that it rapidly evaporates. As the mist evaporates, the general area around the atomizing nozzles becomes cooler. Rapid evaporation prevents people and property located in the mist from getting wet and enhances the cooling effect. Accordingly, misting systems are often used for cooling and for increasing humidity.

FIG. 1 shows a cross-sectional front view of a prior-art atomizing nozzle 20. Prior-art atomizing nozzle 20 is made up of a nozzle body 22 conventionally formed of metal or plastic. Nozzle body 22 conventionally includes a metallic orifice insert 24. Orifice insert 24 has a small orifice 26 through which the fluid passes under pressure to produce the desired fog or mist. In addition, an impeller 28, also called a plunger or poppet, is positioned within a fluid chamber 30 that connects to orifice 26. The action of impeller 28 within fluid chamber 30 fractures the fluid and produces a finer fog or mist.

Orifice 26 is typically formed of a hard metal, such as stainless steel, to minimize the effects of erosion. Those skilled in the art will appreciate that, in some embodiments, orifice 26 may be produced directly in nozzle body 22, i.e., nozzle body 22 and orifice insert 24 may be formed as one piece. It will be appreciated, however, that having orifice 26 directly in nozzle body 22 increases the cost and difficulty of machining nozzle body 22.

Conventionally, orifice 26 resides in orifice insert 24. Since orifice insert 24 is small, typically less than 0.2 inch in diameter, machining is expensive and time-consuming.

Orifice insert 24 is typically pressed into place in nozzle body 22 with great force to produce a fluid-tight seal even when the fluid is under high pressure. This requires that orifice insert 24 be of sufficient strength to resist deformation during the pressing process. This, too, increases cost.

Since orifice insert 24 is pressed into the nozzle body with great force, it cannot thereafter be removed for subsequent cleaning of orifice 26 to remove any deposited mineral materials. In time, these deposited mineral materials will eventually completely block orifice 26 and inhibit passage of the fluid. Atomizing nozzle 20 will then no longer be able to produce the desired fog or mist.

Accordingly, conventional atomizing nozzles 20 are expensive to manufacture and become clogged during use. Such clogged atomizing nozzles 20 cannot readily be unclogged, necessitating the purchase and installation of replacement atomizing nozzles 20.

Prior-art atomizing nozzle 20 conventionally has cup-shaped orifice insert 24. That is, orifice insert 24 has a cylindrical shape with an inside wall 32 substantially parallel to a centerline 34. The cup shape provides strength so as to avoid warpage of orifice insert 24 while being pressed into nozzle body 22.

The cup shape of orifice insert 24, while providing strength, adds significantly to fabrication costs. The small size of orifice insert 24 greatly increases the difficulty and care with which orifice insert 24 must be machined and handled.

Additionally, since conventional orifice inserts 24 are cup-shaped for increased strength, nozzle bodies 22 have a considerable length 36 to contain the cup. Such a "deep" body contains a considerable amount of material that serves no function but to accommodate a cup-shaped orifice insert 24. This excess material undesirably increases the mass of nozzle body 22. This increased mass equates to excesses in both the costs of raw materials to produce nozzle bodies 22 and the costs of shipping the finished atomizing nozzles 20.

A need exists, therefore to configure and manufacture an atomizing nozzle at less expense than has been achieved conventionally.

SUMMARY OF THE INVENTION

Accordingly, it is an advantage of the present invention that an improved atomizing nozzle and method for manufacture thereof are provided.

Another advantage of the present invention is that an atomizing nozzle is provided that has a nozzle body constructed of a first metal and an orifice insert fabricated of a second metal.

Another advantage of the present invention is that an atomizing nozzle is provided that has an orifice insert formed from a metallic sheet material.

The above and other advantages of the present invention are carried out in one form by an atomizing nozzle for use in a misting system. The atomizing nozzle is made up of a nozzle body having a nozzle inlet end, having a nozzle outlet end, and encompassing a fluid chamber between the inlet and outlet ends, an orifice insert stamped from a metallic sheet material and affixed to the nozzle body proximate the outlet end, and an impeller configured to reside within the fluid chamber between the orifice insert and the inlet end.

The above and other advantages of the present invention are carried out in another form by a method of manufacturing an atomizing nozzle for use in a misting system. The method includes constructing a nozzle body encompassing a chamber, fabricating an orifice insert of a sheet material, producing an impeller, inserting the impeller into the chamber, and affixing the orifice insert into the nozzle body.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 2:
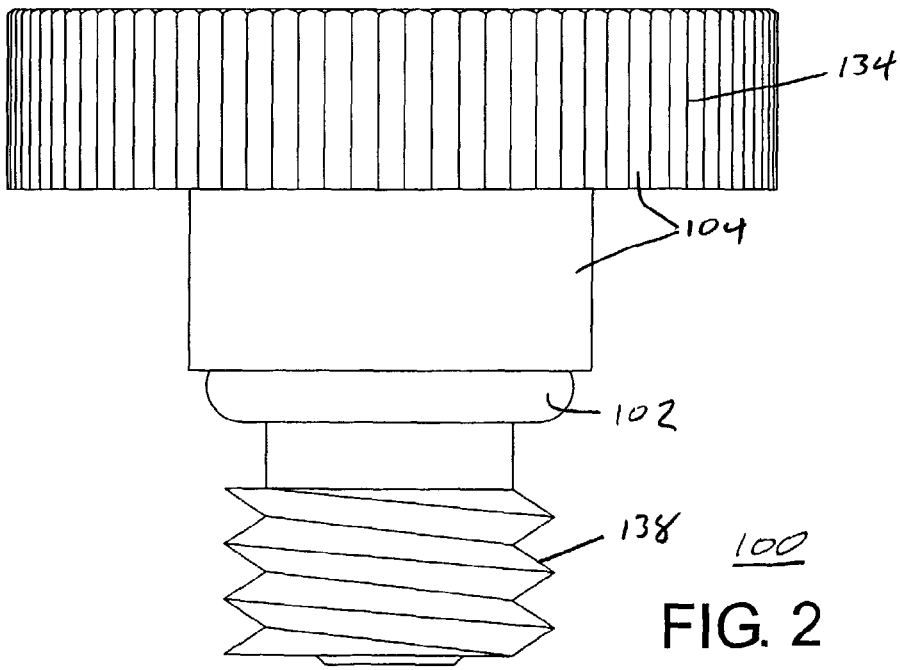
FIG. 2 shows a front view of an atomizing nozzle in accordance with a preferred embodiment of the present invention.
Figure 3:
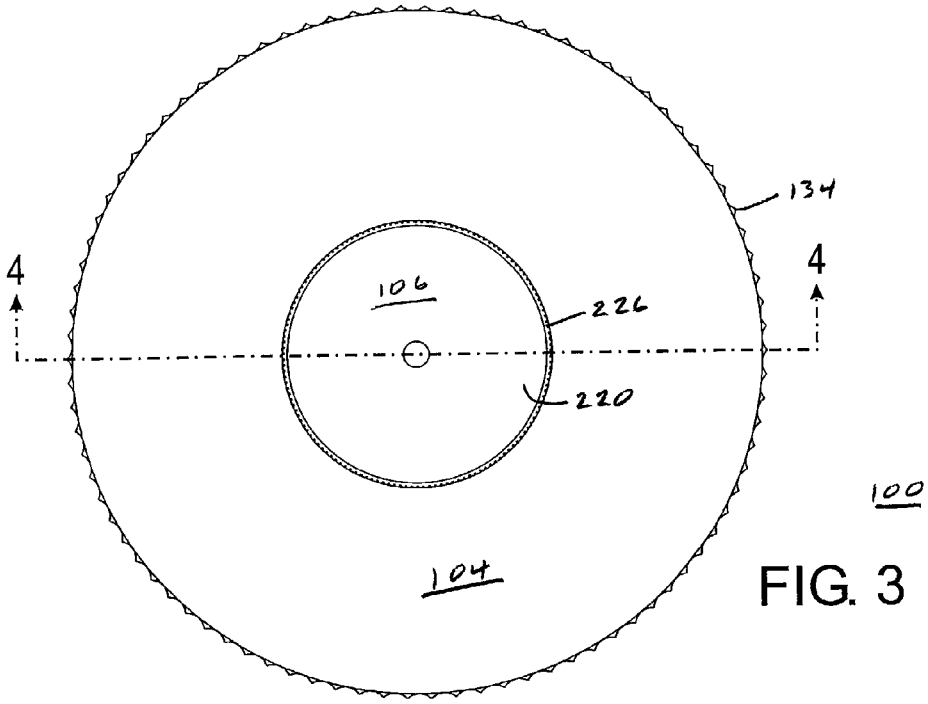
FIG. 3 shows a top view of the atomizing nozzle of FIG. 2 in accordance with a preferred embodiment of the present invention.
Figure 4:
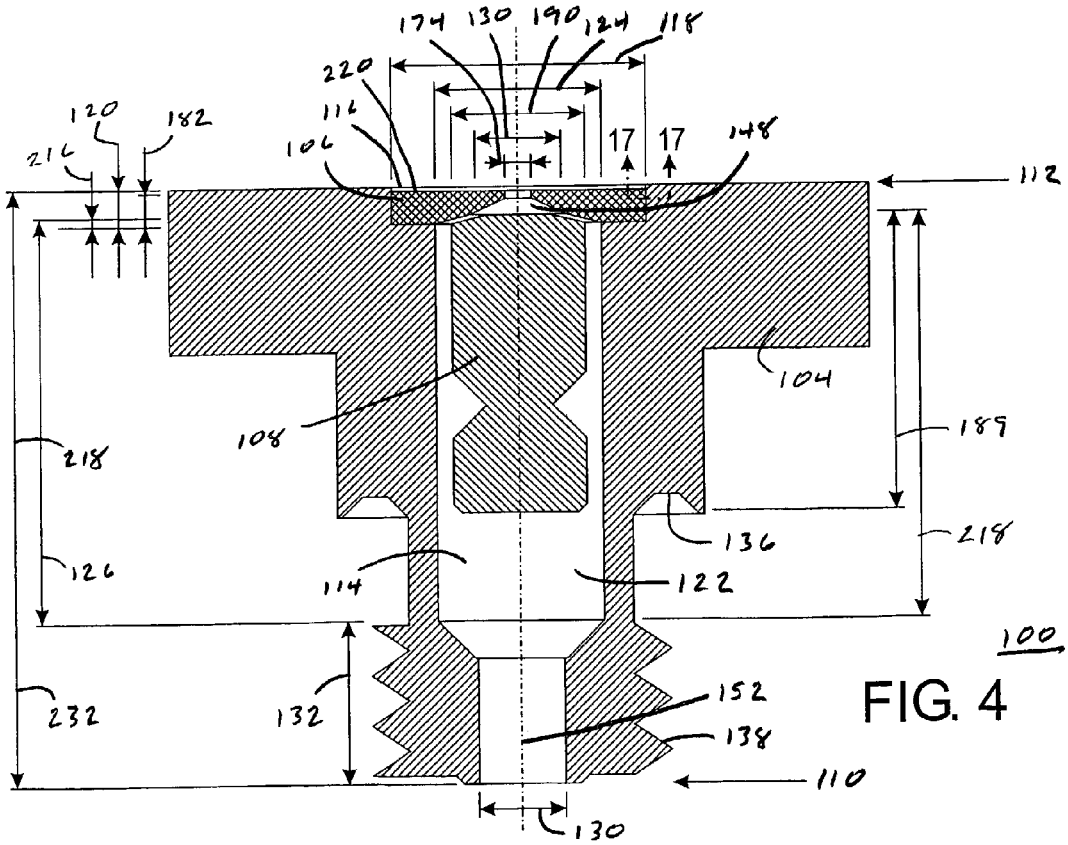
FIG. 4 shows a cross-sectional front view of an atomizing nozzle in accordance with a preferred embodiment of the present invention.

FIG. 2 shows a front view and FIG. 3 shows a top view of an atomizing nozzle 100 in accordance with a preferred embodiment of the present invention. FIG. 4 shows a cross-sectional front view, taken at line 4-4 of FIG. 3, depicting atomizing nozzle 100 with an O-ring 102 removed for clarity. The following discussion refers to FIGS. 2, 3, and 4.

Atomizing nozzle 100 is configured for attachment to a pipe (not shown) in a misting system (not shown), thereby providing a fine mist or fog for cooling and/or hydration. Atomizing nozzle 100 is made up of a nozzle body 104, an orifice insert 106, an impeller 108 (also known as a plunger or poppet), and O-ring 102. Nozzle body 104 has an inlet end 110 and an outlet end 112. Nozzle body 104 also encompasses a fluid chamber 114 between inlet end 110 and outlet end 112. Orifice insert 106 is affixed to nozzle body 104 proximate outlet end 112. Impeller 108 resides within fluid chamber 114 of nozzle body 104.

Figure 5:
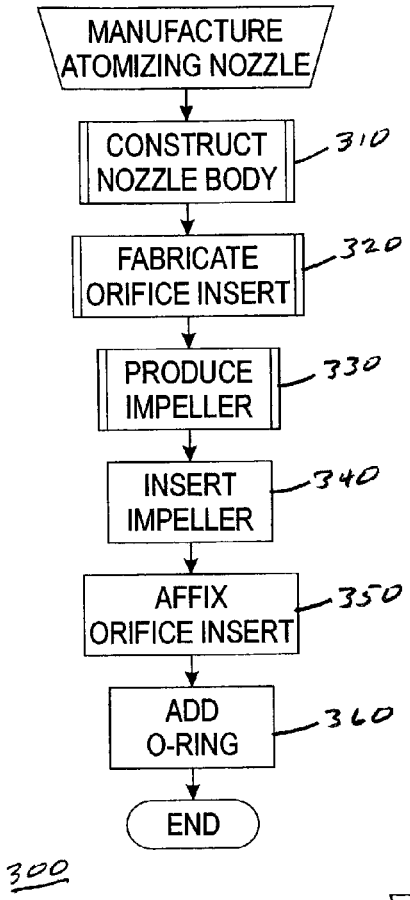
FIG. 5 shows a flowchart of a process to manufacture the atomizing nozzle of FIG. 2 in accordance with a preferred embodiment of the present invention.
Figure 6:
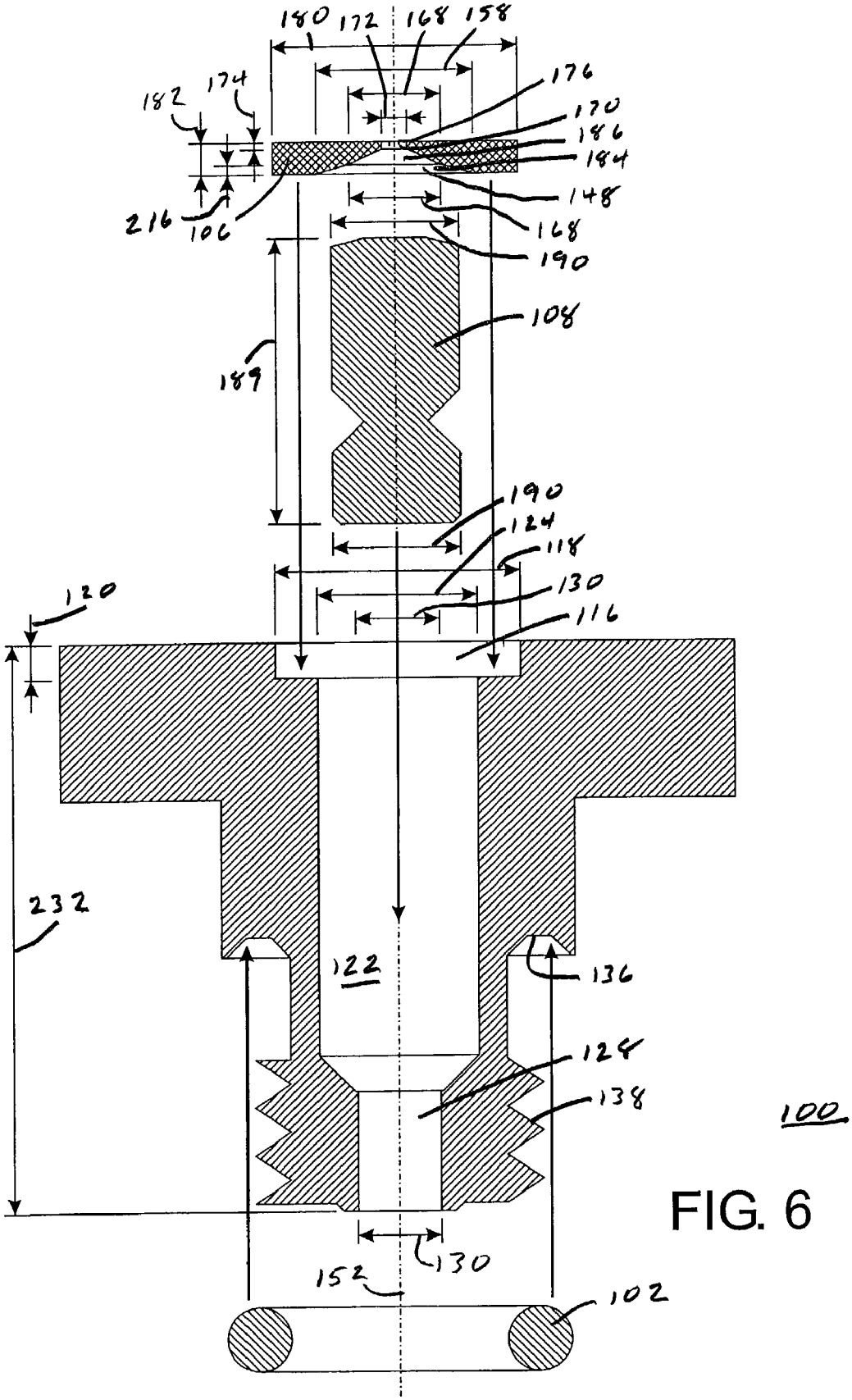
FIG. 6 shows a cross-sectional exploded front view taken at line 4-4 of FIG. 3 demonstrating the components of the atomizing nozzle of FIG. 2 in accordance with a preferred embodiment of the present invention.

FIG. 5 shows a flowchart of a process 300 to manufacture atomizing nozzle 100 in accordance with a preferred embodiment of the present invention. FIG. 6 shows a cross-sectional exploded front view, taken at line 4-4 of FIG. 3, demonstrating the assembly of atomizing nozzle 100 in accordance with a preferred embodiment of the present invention. The following discussion refers to FIGS. 2, 3, 4, 5, and 6.

Atomizing nozzle 100 may be manufactured and assembled as delineated in process 300. The components of atomizing nozzle 100 are created and integrated by subprocesses within process 300. These subprocesses are discusses hereinafter and delineated in FIGS. 7, 8, and 14.

Figure 7:
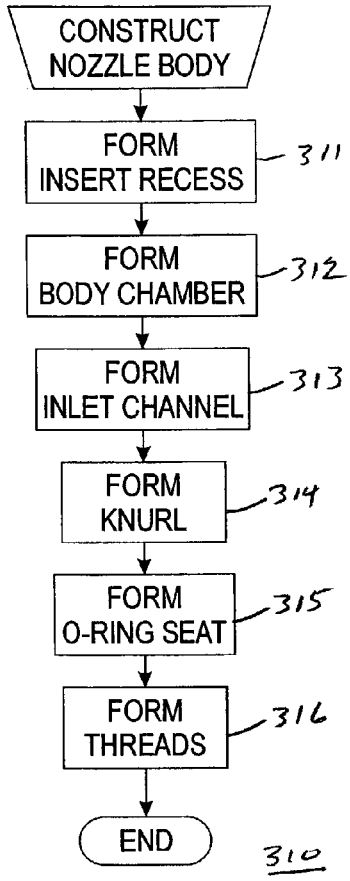
FIG. 7 shows a flowchart of a subprocess to construct a nozzle body for the atomizing nozzle of FIG. 2 in accordance with a preferred embodiment of the present invention.

As shown in FIG. 5, nozzle body 104 is constructed during a subprocess 310 of process 300. FIG. 7 shows a flowchart of subprocess 310 in accordance with a preferred embodiment of the present invention. The following discussion refers to FIGS. 2, 3, 4, 5, 6, and 7.

Nozzle body 104 is constructed by subprocess 310 of process 300. Subprocess 310 contains tasks 311, 312, 313, 314, 315, and 316 to form various features of nozzle body 104.

In task 311, subprocess 310 forms an insert recess 116 in nozzle body 104 proximate inlet end 110. In the preferred embodiment, insert recess 116 is formed as substantially a right-cylindrical opening extending into nozzle body 104 from outlet end 110. Insert recess 116 has a recess diameter 118 and a recess depth 120. Insert recess 116 is configured to contain orifice insert 106.

In task 312, subprocess 310 forms a body chamber 122. Body chamber 122 is formed as substantially a right-cylindrical opening extending into nozzle body 104 from insert recess 116. Body chamber 122 has a body-chamber diameter 124 and a body-chamber length 126. It will be appreciated that other shapes may be used for body chamber 122. The use of another shape does not depart from the spirit of the present invention.

In task 313, subprocess 310 forms a fluid inlet channel 128. Inlet channel 128 is formed substantially as a right-cylindrical opening extending through nozzle body 104 from body chamber 122 to inlet end 110. Inlet channel 128 has an inlet-channel diameter 130 and an inlet-channel length 132. It will be appreciated that other shapes may be used for fluid inlet channel 128. The use of another shape does not depart from the spirit of the present invention.

In task 314, subprocess 310 forms a knurl 134 (FIGS. 2 and 3) around an outside of nozzle body 104. Knurl 134 serves to allow atomization nozzle 100 to be attached to and detached from a pipe (not shown) by hand. It will be appreciated that other methods of attachment and detachment may be possible or desirable. In this case, task 314 may form any desired shape or texture (e.g., a hexagonal shape).

In task 315, subprocess 310 forms a seat 136 for O-ring 102. O-ring seat 136 is depicted in FIG. 4, from which Figure O-ring 102 has been removed for clarity. O-ring 102 is depicted in FIG. 2, and is depicted seated in O-ring seat 136 in FIG. 19 (discussed hereinafter).

And in task 316, subprocess 310 forms threads 138. Threads 138 serve to attach atomizing nozzle 100 to a pipe (not shown) of a misting system (not shown). It will be appreciated that other methods of attachment may be possible or desirable. In this case, task 314 may form the desired attachment means (e.g., a crimp fitting) without departing from the spirit of the present invention.

In the preferred embodiment, the misting system (not shown) is a high-pressure water-based misting system. Nozzle body 104 is therefore desirably constructed of a stable metal, such as brass, suitable for use with such a misting system. Those skilled in the art will appreciate that, depending upon the use for which the misting system is intended, other materials may be desirable.

Depending upon the material of which nozzle body 104 is to be constructed, subprocess 310 may involve molding, machining, or otherwise producing the features formed by tasks 311, 312, 313, 314, 315, and 316 using established techniques. It will also be appreciated that the order of tasks 311, 312, 313, 314, 315, and 316 within subprocess 310 is irrelevant to this discussion. For example, tasks 311, 312, 313, 314, 315, and 316 may be performed substantially simultaneously if subprocess 310 constructs nozzle body 104 by molding.

Figure 8:
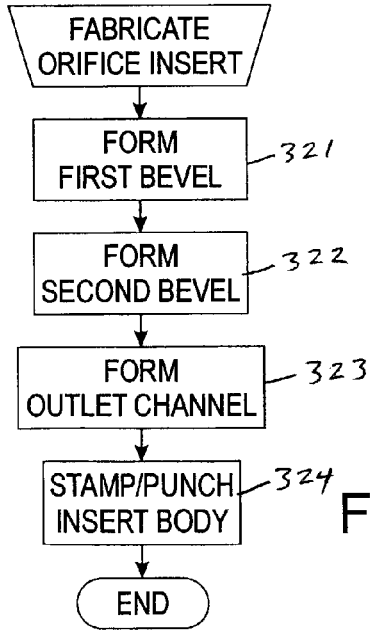
FIG. 8 shows a flowchart of a subprocess to fabricate an orifice insert for the atomizing nozzle of FIG. 2 in accordance with a preferred embodiment of the present invention.
Figure 9:
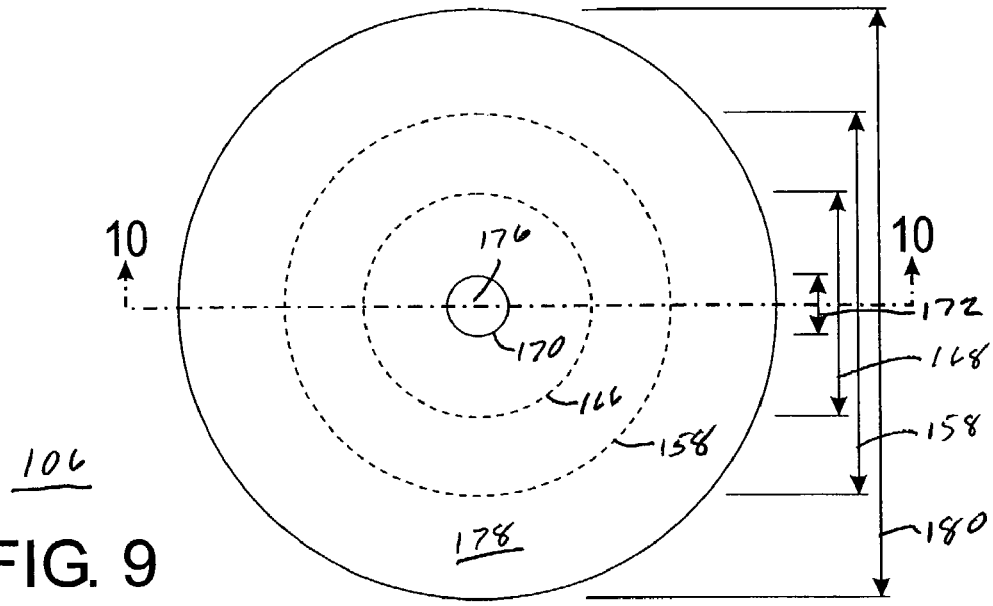
FIG. 9 shows a top view of an orifice insert for the atomizing nozzle of FIG. 2 in accordance with a preferred embodiment of the present invention.
Figure 10:
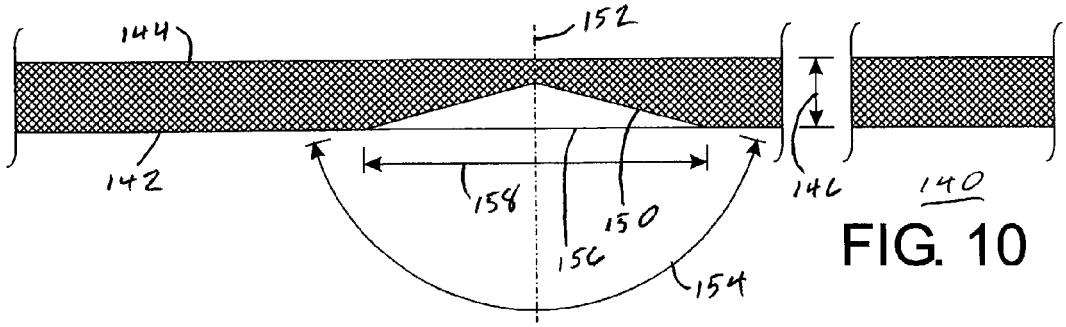
FIG. 10 shows a cross-sectional front view taken at line 10-10 of FIG. 9 of a sheet material during a first portion of the subprocess of FIG. 8 in accordance with a preferred embodiment of the present invention.
Figure 11:
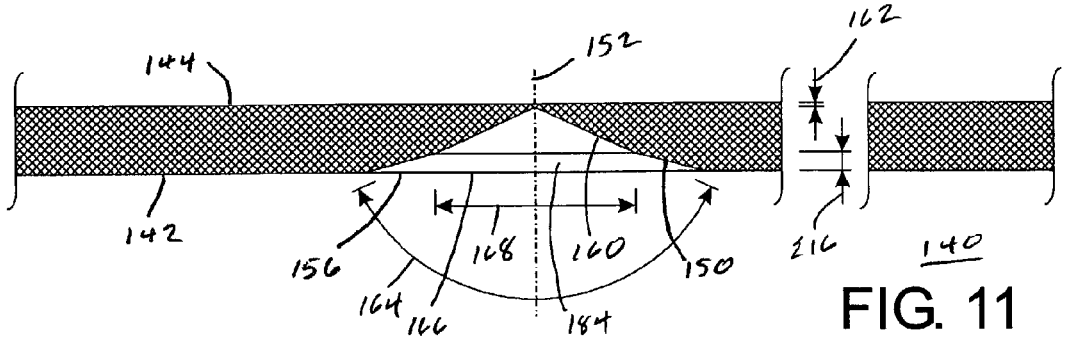
FIG. 11 shows a cross-sectional front view taken at line 10-10 of FIG. 9 of a sheet material during a second portion of the subprocess of FIG. 8 in accordance with a preferred embodiment of the present invention.
Figure 12:
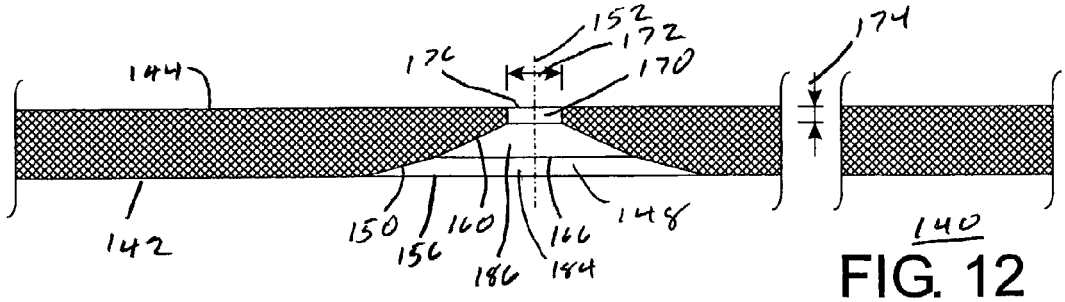
FIG. 12 shows a cross-sectional front view taken at line 10-10 of FIG. 9 of a sheet material during a third portion of the subprocess of FIG. 8 in accordance with a preferred embodiment of the present invention.
Figure 13:
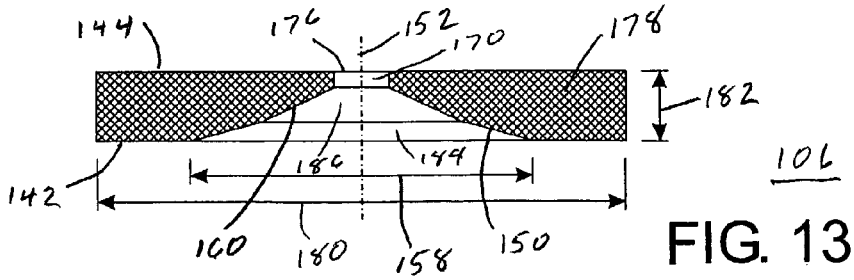
FIG. 13 shows a cross-sectional front view of the orifice insert of FIG. 9 taken at line 10-10 of FIG. 9 in accordance with a preferred embodiment of the present invention.

As shown in FIG. 5, orifice insert 106 is fabricated during a subprocess 320 of process 300. FIG. 8 shows a flowchart of subprocess 320 in accordance with a preferred embodiment of the present invention. FIG. 9 shows a top view of orifice insert 106 for atomizing nozzle 100, FIGS. 10, 11, and 12 show cross-sectional front views, taken at line 10-10 of FIG. 9, of a sheet material 140 during first, second, and third portions of the fabrication of orifice insert 106, and FIG. 13 shows a cross-sectional front view, taken at line 10-10 of FIG. 9, of orifice insert 106 in accordance with a preferred embodiment of the present invention. The following discussion refers to FIGS. 5, 6, 8, 9, 10, 11, 12, and 13.

Orifice insert 106 is fabricated by subprocess 320 of process 300 from sheet material 140 having a first surface 142, a second surface 144, and a material thickness 146. In the preferred embodiment, sheet material 140 is desirably stainless steel and material thickness 146 is no greater than 0.055 inch. Ideally, material thickness 146 is 0.020 inch±0.0025 inch.

Subprocess 320 contains tasks 321, 322, 323, and 324 to form various features of orifice insert 106. In task 321 (FIGS. 8, 9, and 10), subprocess 320 begins the formation of an insert chamber 148 by forming a first substantially conical bevel 150 into first surface 142 of sheet material 140 about an arbitrary insert centerline 152 substantially perpendicular to first and second surfaces 142 and 144. First bevel 150 is desirably formed by chamfering.

First bevel 150 is formed at a first-bevel angle 154. First bevel 150 intersects first surface 142 in a substantially circular demarcation 156 having a first-bevel diameter 158.

In task 322 (FIGS. 8, 9, and 11), subprocess 320 completes the formation of insert chamber 148 by forming a second substantially conical bevel 160 from first bevel 150 towards second surface 144 of sheet material 140 about centerline 152 and to a depth where remaining material of sheet material 140 at centerline 152 has a remaining thickness 162. In the preferred embodiment, remaining thickness 162 is 0.001±0.001 inch, desirably ±0.00025 inch. Second bevel 160 is desirably formed by chamfering.

Second bevel 160 is formed at a second-bevel angle 164 less than first-bevel angle 154. Second bevel 160 intersects first bevel 150 in a substantially circular demarcation 166 having a second-bevel diameter 168

In task 323, subprocess 320 forms a fluid outlet channel 170 from second bevel 160 through to second surface 144 of sheet material 140 about centerline 152. Desirably, outlet channel 170 is formed by boring. An outside end of outlet channel 170 (i.e., the end coincident with second surface 144) forms an orifice 176.

Outlet channel 170 has an outlet-channel diameter 172 and an outlet-channel length 174. Since orifice 176 is the outlet end of outlet channel 170, outlet-channel diameter 172 is also the diameter of orifice 176. In the preferred embodiment of the Figures, outlet-channel diameter 172 is 0.0157 inch±0.005 inch, desirably ±0.0002 inch. This is not a requirement of the present invention, however, and those skilled in the art will appreciate that outlet-channel diameter 172 may assume other values as required by specific applications. For example, nominal outlet-channel channel diameters 172 of 0.006, 0.008, 0.012, 0.015, 0.020, 0.025, and 0.030 inch have all been used for specific applications. The use of another value for outlet-channel diameter 172 does not depart from the spirit of the present invention.

In task 324, subprocess 320 forms orifice insert 106 by stamping or punching a substantially cylindrical orifice insert 178 from sheet material 140 about centerline 152. Orifice insert 178 has an insert diameter 180 substantially equal to recess diameter 118. In the preferred embodiment, insert diameter 180 is 0.153 inch +0.100 −0.050 inch, desirably ±0.005 inch. Orifice insert 178 has an insert length 182 substantially equal to material thickness 146 and less than recess depth 120.

In the preferred embodiment, orifice insert 106 is a metallic orifice insert. That is, orifice insert 106 is fabricated of metal. Desirably, orifice insert 106 is fabricated of a metal or an alloy of metals that is substantially non-reactive to air or water (or other fluid to be atomized by atomizing nozzle 100). By being substantially non-reactive, corrosion is kept to a minimum, and the useful lifetime of atomizing nozzle 100 is maximized. Desirably, orifice insert 106 is fabricated of a metal having a hardness at least as great as the hardness of the metal of which nozzle body 104 is constructed. In the preferred embodiment, nozzle body 104 is constructed of brass and orifice insert 106 is fabricated of stainless steel. Those skilled in the art will appreciate that orifice insert 106 may be fabricated of other materials, e.g., alloys of aluminum, titanium, and magnesium, without departing from the spirit of the present invention.

Those skilled in the art will appreciate that subprocess 320 may involve machining or otherwise producing the features formed by tasks 321, 322, and 323 using established techniques. Subprocess 320 involves stamping for task 324. It will also be appreciated that the order of tasks 321, 322, 323 within subprocess 320 is irrelevant to this discussion. It will be appreciated that task 324 of the preferred embodiment of subprocess 320 involves stamping to produce orifice insert 106, and is therefore normally the last task of subprocess 320, though this is not a requirement of the present invention. Stamping is desirable for task 324 because it allows the extraction of orifice insert 106 from sheet material 140 at a minimum cost and effort. This effects significant savings in the per-nozzle costs of atomizing nozzles 100.

Figure 1:
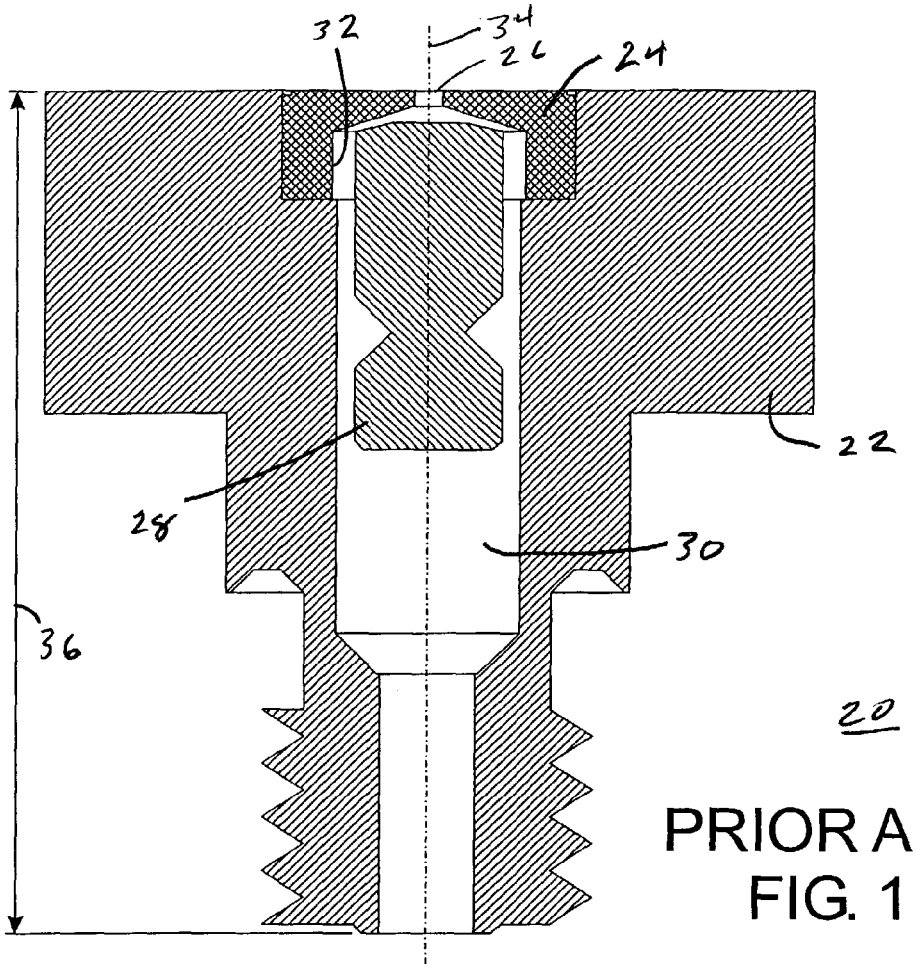
PRIOR ART FIG. 1
FIG. 1 shows a cross-sectional front view of a prior-art atomizing nozzle.

Referring to FIGS. 9 and 13, it may be seen that orifice insert 106 has the shape of a disk with a depressed center. That is, first and second bevels 150 and 160 produce "interior walls" positioned obliquely relative to centerline 152. This is in marked contrast to the cup-shaped prior art orifice insert 24 of FIG. 1, where inside walls 32 are substantially parallel to centerline 34. The absence of the cup shape allows orifice insert 106 to be significantly thinner than prior-art orifice insert 24. This in turn allows a length 232 of nozzle body 104 (FIG. 4) to be significantly shorter than the length 36 of prior-art nozzle body 22, with corresponding savings in material and mass.

Within orifice insert 106, second-bevel demarcation 166 divides insert chamber 148 into a first-bevel portion 184 and a second-bevel portion 186. First-bevel portion 184, i.e., that portion of insert chamber 148 bounded by first bevel 150 between first-bevel demarcation 156 and second-bevel demarcation 166, is contiguously joined with body chamber 122 (FIG. 6) to form fluid chamber 114. This is discussed in more detail hereinafter.

Second-bevel portion 186 is that portion of insert chamber between second-bevel demarcation 166 and outlet channel 170. Second-bevel portion 186 serves as a chamber between impeller 108 and orifice 176 in which the water or other fluid may gather prior to final atomization. This chamber serves to produce a finer mist.

Second-bevel angle 164 is less than first-bevel angle 154 to increase the size of second bevel portion 186 to further improve atomization. Those skilled in the art will appreciate that, in some embodiments, second-bevel angle 164 may substantially equal first-bevel angle 154. That is, second bevel 160 may be omitted, and the chamber between impeller 108 and orifice 176 may be produced by an extension of first bevel 150 to outlet channel 170. Such an embodiment may be produced by omitting task 322 of subprocess 320 (FIG. 8). The omission of task 322 does not depart from the spirit of the present invention.

Figure 14:
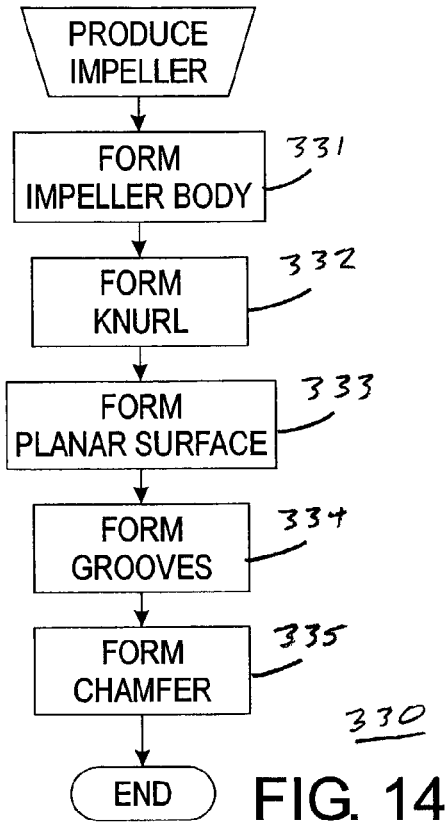
FIG. 14 shows a flowchart of a subprocess to produce an impeller for the atomizing nozzle of FIG. 2 in accordance with a preferred embodiment of the present invention.
Figure 15:
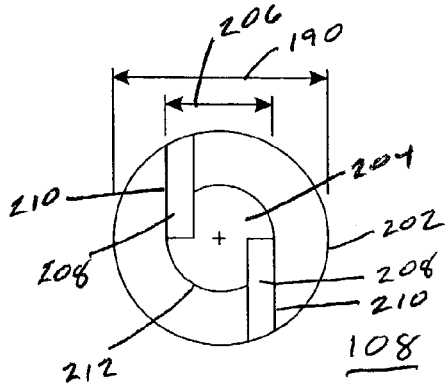
FIG. 15 shows a top view of an impeller in accordance with a preferred embodiment of the present invention.
Figure 16:
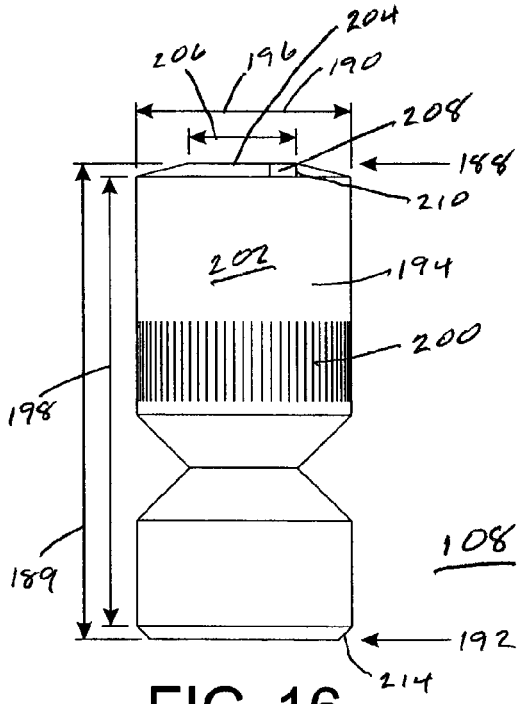
FIG. 16 shows a front view of an impeller in accordance with a preferred embodiment of the present invention.

As shown in FIG. 5, impeller 108 is produced during a subprocess 330 of process 300. FIG. 14 shows a flowchart of subprocess 330 in accordance with a preferred embodiment of the present invention. FIG. 15 shows a top view of impeller 108 depicting an impeller outlet end 188, and FIG. 16 shows a front view of impeller 108 in accordance with a preferred embodiment of the present invention. The following discussion refers to FIGS. 4, 5, 6, 14, 15, and 16.

Subprocess 330 includes tasks 331, 332, 333, 334, and 335. Impeller 108 is a cylindroid having a length 189 and a diameter 190. Impeller 108 has outlet end 188, an inlet end 192, and a cylindrical body 194 between outlet and inlet ends 188 and 192.

In task 331, subprocess 330 forms body 194 of impeller 108. Impeller body 194 has a diameter 196 substantially equal to impeller diameter 190. Impeller body 194 also has a length 198 that is less than impeller length 189.

In task 332, subprocess 330 forms a knurl 200 around an outside surface 202 of impeller body 194. Impeller knurl 200 serves to fracture the water or other fluid during operation. Those skilled in the art will appreciate that knurl 200 is not a requirement of the present invention. The omission of task 332, and of knurl 200, does not depart from the spirit of the present invention.

In task 333, subprocess 330 forms a raised substantially circular planar surface 204 at impeller outlet end 188. Planar surface 204 has a diameter 206 less than that of impeller diameter 190.

In task 334, subprocess 330 forms grooves 208 at impeller outlet end 188. Grooves 208 have an outer edge 210, which is substantially tangential to a circumference 212 of planar surface 204. Grooves 208 serve to further fracture the water or other fluid during operation.

And in task 335, subprocess 330 forms a chamfer 214 at impeller inlet end 192. Chamfer 214 aids in the insertion of impeller 108 into nozzle body 104. Those skilled in the art will appreciate that chamfer 214 is not a requirement of the present invention. The omission of task 335, and of chamfer 214, does not depart from the spirit of the present invention.

In the preferred embodiment of the Figures, impeller 108 is depicted as a waisted impeller. In practice, impeller 108 may be cylindrical, waisted, frusto-conical, or any other form known to those skilled in the art. The form of impeller 108 is irrelevant to the present invention and other forms may be used without departing from the spirit of the present invention.

Those skilled in the art will appreciate that, depending upon the material of which impeller 108 is produced, subprocess 330 may involve molding, machining, or otherwise producing the features formed by tasks 331, 332, 333, 334, and 335 using established techniques. It will also be appreciated that the order of tasks 331, 332, 333, 334, and 335 within subprocess 330 is irrelevant to this discussion. For example, tasks 331, 332, 333, 334, and 335 may be performed substantially simultaneously if subprocess 330 produces impeller 108 by molding.

Those skilled in the art will appreciate that the order in which subprocesses 310, 320, and 330 are performed, i.e., the order in which nozzle body 104, orifice insert 106, and impeller 108 are produced, is irrelevant. Changing the order from that exemplified in this discussion does not depart from the spirit of the present invention.

The following discussion refers to FIG. 4.

Fluid chamber 114 is formed of insert chamber 148 and body chamber 122. Impeller 108 is configured to reside within fluid chamber 114. In order to fulfill its function, impeller 108 should be able to spin, vibrate, and otherwise move within fluid chamber 114. Therefore, fluid chamber 114 should have a diameter greater than impeller diameter 190 and a length greater than impeller length 189.

Fluid chamber 114 is formed by concatenating body chamber 122 and first-bevel portion 184 of insert chamber 148. First-bevel portion 184 of insert chamber 148 has a first-bevel-portion length 216. Body chamber 122 has body chamber length 126. Therefore, fluid chamber 114 has a length 218 that is the sum of first-bevel-portion length 216 and body chamber length 126.

Impeller 108 should be free to move inside fluid chamber 114. Therefore, impeller diameter 190 is less than body-chamber diameter 124. Similarly, impeller length 189 is less than fluid-chamber length 218.

Fluid chamber 114 is bound on one end by inlet channel 128 and on the other end by second-bevel portion 186 of insert chamber 148. Since it is desirable that impeller 108 be retained within fluid chamber 114, impeller diameter 190 is greater than either diameter 130 of inlet channel 128 or diameter 168 of second-bevel demarcation 166.

Figure 17:
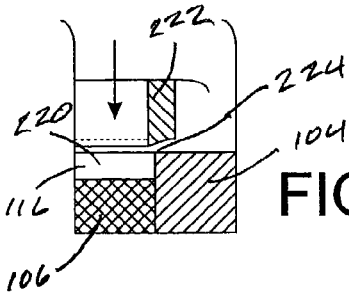
FIG. 17 shows a cross-sectional front view taken at line 17-17 of FIG. 4 of the atomizing nozzle of FIG. 2 during insertion of the orifice insert into the nozzle body in accordance with a preferred embodiment of the present invention.
Figure 18:
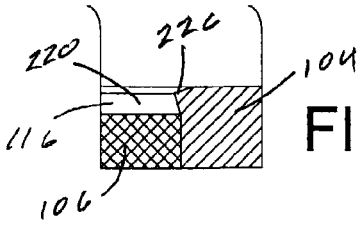
FIG. 18 shows a cross-sectional front view taken at line 17-17 of FIG. 4 of the atomizing nozzle of FIG. 2 after insertion of the orifice insert into the nozzle body in accordance with a preferred embodiment of the present invention.

FIG. 6 also shows a cross-sectional front view of atomizing nozzle 100 prior to assembly and FIGS. 17 and 18 show a magnified portion of atomizing nozzle 100 encompassed by line 17-17 of FIG. 4 during (FIG. 17) and after (FIG. 18) insertion of orifice insert 106 into nozzle body 104 in accordance with a preferred embodiment of the present invention. The following discussion refers to FIGS. 2, 3, 4, 5, 6, 17, and 18.

With the completion of subprocesses 310, 320 and 330, the principal components of atomizing nozzle 100 are ready for assembly. In a task 340 of process 300 (FIG. 4), inlet end 192 of impeller 108 is inserted into body chamber 122 through insert recess 116. Chamfer 214 guides impeller 108 into body chamber 122. Since impeller diameter 190 is greater than inlet-channel diameter 130, impeller 108 is inhibited from entering inlet channel 128 and remains in body chamber 122.

In a task 350 of process 300, orifice insert 106 is affixed to nozzle body 104. In the preferred embodiment, nozzle body 104 is constructed of brass and orifice insert 106 is fabricated of stainless steel. It will be appreciated, however, that these precise materials are not a requirement of the present invention and other materials may be used.

Orifice insert 106 is inserted into insert recess 116 or nozzle body 104. Desirably, orifice insert 106 and insert recess 116 are dimensioned so that insert diameter 180 is substantially equal to recess diameter 118. This allows orifice insert 106 to be press-fitted into insert recess 116 in a manner well known to those skilled in the art. Desirably, insert length 182 is less than recess depth 120, thereby allowing orifice insert 106 to be pressed to the bottom of insert recess 116 leaving a mounting recess 220. A crimping or riveting tool 222 (FIG. 17) may then be used to distort an edge 224 of insert recess 116. Distorted edge 226 (FIG. 18) then entraps orifice insert 106 inside of insert recess 116.

Those skilled in the art will appreciate that other methods of affixing orifice insert 106 to or into nozzle body 104 may be used without departing from the spirit of the present invention.

In a final task 360, O-ring 102 is added to atomizing nozzle 100. O-ring 102, in conjunction with O-ring seat 136, allows atomizing nozzle 100 to make a watertight connection with a pipe (not shown) of the misting system (not shown).

Those skilled in the art will appreciate that the method of assembling atomizing nozzle 100 described hereinbefore is exemplary only, and that a plurality of other equivalent methods may be used. The use of another method of assembly does not depart from the spirit of the present invention.

Figure 19:
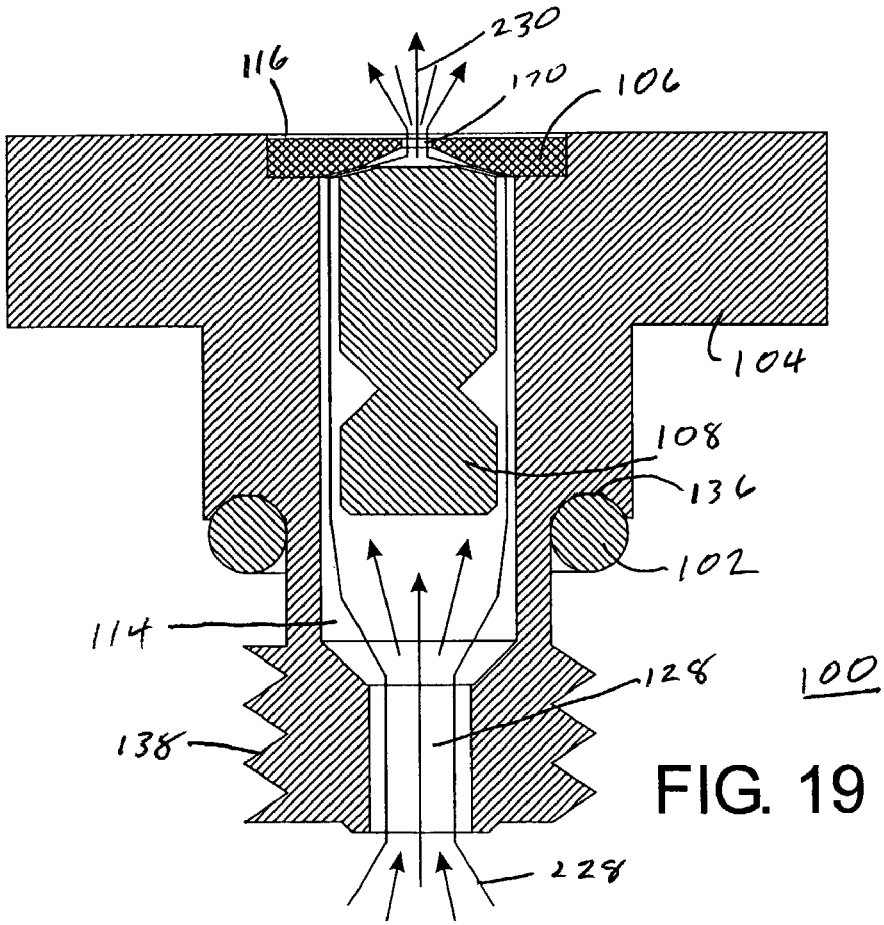
FIG. 19 shows a cross-sectional front view taken at line 4-4 of FIG. 3 of the atomizing nozzle of FIG. 2 during operation in accordance with a preferred embodiment of the present invention.

FIG. 19 shows a cross-sectional front view taken at line 4-4 of FIG. 3 of atomizing nozzle 100 during operation in accordance with a preferred embodiment of the present invention. The following discussion refers to FIG. 19.

When atomizing nozzle 100 is connected to a pipe (not shown) of a misting system (not shown) and pressure is applied, water 228 (or other fluid) is forced into fluid inlet channel 128. From fluid inlet channel 128, water 228 enters fluid chamber 114. In fluid chamber 114, water 228 flows around impeller 108, imparting spinning, vibrating, and other motions to impeller 108. The motions of impeller 108 cause water 228 to fracture, i.e., produces cavitation of water 228. Fractured water 228 flows from fluid chamber 114 into outlet channel 170. Water 228 then exits outlet channel 170 via orifice 176 as a fine mist or fog 230.

The following discussion refers to FIGS. 1, 4, 1, 11, 12, and 13.

One distinct advantage of atomizing nozzle 100 over prior-art atomizing nozzle 20 is that orifice insert 106 was fabricated from sheet material 140 and has an insert length 182 no greater than 0.055 inch. This allows nozzle body 104 to have a length 232 considerably less than the length 36 of prior-art nozzle body 22. Nozzle body 104 therefore realizes significant savings in material over prior-art nozzle body 22. These savings in material produce a decrease in the mass of nozzle body 104 over prior-art nozzle body 22. This decease in mass equates to reductions in both the costs of raw materials to produce nozzle bodies 104 and the costs of shipping the finished atomizing nozzles 100.

In summary, the present invention teaches an improved atomizing nozzle 100 and a process 300 for the manufacture of atomizing nozzle 100. Atomizing nozzle 100 has a nozzle body constructed of a first metal, an orifice insert 106 fabricated of a sheet material 140 of a second metal, and an impeller 108. Atomizing nozzle 100 is manufactured of materials to resist the rapid build-up of residual mineral materials contained in the water 228 or other fluid.

Although the preferred embodiments of the invention have been illustrated and described in detail, it will be readily apparent to those skilled in the art that various modifications may be made therein without departing from the spirit of the invention or from the scope of the appended claims.

What is claimed is:

1. An atomizing nozzle for use in a misting system, said atomizing nozzle comprising:

a nozzle body having a nozzle inlet end, having a nozzle outlet end, and encompassing a fluid chamber between said nozzle inlet end and said nozzle outlet end;

an orifice insert fabricated from a metallic sheet material and affixed to said nozzle body proximate said nozzle outlet end, wherein said orifice insert comprises:

a first substantially conical bevel formed within said metallic sheet material;

a second substantially conical bevel formed within said metallic sheet material from said first bevel;

a substantially cylindrical outlet channel formed within said metallic sheet material from said second bevel; and an insert body stamped from said metallic sheet material; and an impeller configured to reside within said fluid chamber between said orifice insert and said nozzle inlet end.

2. An atomizing nozzle as claimed in claim 1 wherein said orifice insert is fabricated from said metallic sheet material by stamping.

3. An atomizing nozzle as claimed in claim 1 wherein said nozzle body comprises:

an insert recess;

a body chamber configured to form at least a portion of said fluid chamber and formed in concatenation with said insert recess; and a fluid inlet channel formed in concatenation with said body chamber.

4. An atomizing nozzle as claimed in claim 1 wherein:

said sheet material has a material thickness not greater than 0.055 inch;

said first bevel has a first angle and a first diameter;

said second bevel has a second angle less than said first angle and a second diameter less than said first diameter; and said insert body has a third diameter greater than said first diameter and a length substantially equal to said material thickness.

5. An atomizing nozzle as claimed in claim 1 wherein:

said sheet material has a thickness;

said first bevel has a first angle and a first diameter;

said second bevel has a second angle less than said first angle and a second diameter less than said first diameter;

said outlet channel has an third diameter less than said second diameter; and said insert body has a fourth diameter greater than said first diameter and a length substantially equal to said thickness.

6. An atomizing nozzle as claimed in claim 1 wherein said metallic sheet material is a stainless-steel sheet material.

7. An atomizing nozzle as claimed in claim 1 wherein said impeller comprises:

an impeller length;

an impeller diameter;

an impeller inlet end;

an impeller outlet end, wherein said impeller inlet end is closer to said nozzle inlet end than said nozzle outlet end when said nonmetallic impeller resides within said fluid chamber;

a planar surface at said impeller outlet end, wherein said planar surface is substantially circular, has a surface circumference, and has a surface diameter less than said impeller diameter; and a plurality of grooves at said impeller outlet end, where each of said grooves has an outer edge substantially tangential to said surface circumference.

8. An atomizing nozzle as claimed in claim 1 wherein:
said nozzle body is formed of a first metal; and
said orifice insert is formed of a second metal.

9. An atomizing nozzle as claimed in claim 8 wherein:
said first metal has a first hardness; and
said second metal has a second hardness greater than or equal to said first metal.

10. An atomizing nozzle as claimed in claim 8 wherein:
said first metal is brass; and
said second metal is stainless steel.

11. An atomizing nozzle as claimed in claim 1 wherein said fluid chamber comprises:
a substantially cylindrical first chamber having a first chamber diameter, and having a first chamber length; and
a substantially conical second chamber having a second chamber diameter and having a second chamber length.

12. An atomizing nozzle as claimed in claim 11 wherein:
said atomizing nozzle additionally comprises:
an inlet channel having an inlet channel diameter; and
an outlet channel having an outlet channel diameter; and
said impeller has an impeller diameter and an impeller length, wherein;
said impeller diameter is greater than said inlet channel diameter;
said impeller diameter is greater than said outlet channel diameter;
said impeller diameter is less than said first chamber diameter; and
said impeller length is less than a sum of said first and second chamber lengths.

13. A method of manufacturing an atomizing nozzle for use in a misting system, said method comprising:
constructing a nozzle body encompassing a first chamber;
fabricating an orifice insert of a sheet material, wherein said orifice insert has only one outlet channel and encompasses a second chamber;
producing an impeller;
inserting said impeller into said first chamber; and
affixing said orifice insert into said nozzle body.

14. A method as claimed in claim 13 wherein said orifice insert comprises:
forming a substantially conical bevel in said sheet material from a first side thereof and along an insert centerline;
forming a substantially cylindrical outlet channel through said sheet material from said bevel to a second side of said sheet material along said insert centerline; and
stamping a substantially cylindrical body of said orifice insert from said sheet material along said insert centerline.

15. A method as claimed in claim 13 wherein:
said constructing activity comprises forming an insert recess within said nozzle body; and
said affixing activity affixes said orifice insert within said insert recess.

16. A method as claimed in claim 13 wherein said affixing activity affixes said orifice insert to said nozzle body by riveting.

17. A method as claimed in claim 13 wherein said producing activity comprises:
forming said impeller as substantially a cylinder having an impeller diameter;
forming a raised planar surface at a first end of said impeller, wherein said raised planar surface is substantially circular, has a surface circumference, and has a surface diameter less than said impeller diameter; and
forming a plurality of grooves at said first end of said impeller, wherein each of said grooves has an outer edge substantially tangential to said surface circumference.

18. A method as claimed in claim 13 wherein said constructing activity comprises:
forming said first chamber within said nozzle body, wherein said chamber is substantially cylindrical and has a chamber diameter; and
forming an inlet channel within said nozzle body, wherein said inlet channel is substantially cylindrical and has a channel diameter less than said chamber diameter, and wherein said chamber and said inlet channel are contiguous and substantially coaxial.

19. A method as claimed in claim 18 wherein said impeller has an impeller diameter less than said chamber diameter and greater than said channel diameter.

20. A method of manufacturing an atomizing nozzle for use in a misting system, said method comprising:
constructing a nozzle body encompassing a first chamber;
fabricating an orifice insert of a sheet material, wherein said orifice insert encompasses a second chamber, and wherein said fabricating activity comprises:
forming a substantially conical first bevel in said sheet material from a first side thereof and along an insert centerline;
forming a substantially conical second bevel in said sheet material from said first bevel along said insert centerline;
forming a substantially cylindrical outlet channel through said sheet material from said second bevel to a second side of said sheet material along said insert centerline; and
stamping a substantially cylindrical body of said orifice insert from said sheet material along said insert centerline;
producing an impeller;
inserting said impeller into said first chamber; and
affixing said orifice insert into said nozzle body.

21. A planar orifice insert for an atomizing nozzle, said orifice insert comprising:
an insert body fabricated from a metallic sheet material;
an insert chamber formed within said insert body along a centerline, and having walls positioned only obliquely to said centerline wherein said insert chamber comprises:
a first chamber portion formed by a substantially conical first bevel, said first bevel having a first angle and having a first diameter;
a second chamber portion formed by a substantially conical second bevel, said second bevel having a second angle less than said first angle and having a second diameter less than said first diameter; and
a substantially cylindrical outlet channel formed within insert body along said centerline, and having a third diameter less than said second diameter; and
a substantially cylindrical outlet channel formed within insert body along said centerline.

22. An orifice insert as claimed in claim 21 wherein said insert body is fabricated from said metallic sheet material by stamping.

23. An orifice insert as claimed in claim 21 wherein said metallic sheet material is stainless steel.

* * * * *